United States Patent [19]

Cappel

[11] 4,183,299

[45] Jan. 15, 1980

[54] DEVICE FOR FITTING A BLANKET ON THE CYLINDER OF A PRINTING PRESS

[75] Inventor: Bert Cappel, Muhlheim am Main, Fed. Rep. of Germany

[73] Assignee: Roland Offsetmaschinenfabrik, Fed. Rep. of Germany

[21] Appl. No.: 880,571

[22] Filed: Feb. 23, 1978

[30] Foreign Application Priority Data

Feb. 23, 1977 [DE] Fed. Rep. of Germany ..... 2707643

[51] Int. Cl.[2] ..... B41F 27/12

[52] U.S. Cl. ..... 101/415.1

[58] Field of Search ..... 101/415.1

[56] References Cited

U.S. PATENT DOCUMENTS

| | | | |
|---|---|---|---|
| 1,215,344 | 2/1917 | Clark | 101/415.1 |
| 2,578,406 | 12/1951 | Dutro | 101/415.1 |
| 2,737,887 | 3/1956 | Gericke | 101/415.1 |
| 2,822,754 | 2/1958 | Huck | 101/415.1 |
| 3,008,410 | 11/1961 | Bryer | 101/415.1 |
| 3,020,842 | 2/1962 | Neal | 101/415.1 |
| 3,335,663 | 8/1967 | Harenza | 101/415.1 |
| 3,536,009 | 10/1970 | Boehm | 101/415.1 |
| 3,752,075 | 8/1973 | Fusco | 101/415.1 |
| 3,844,214 | 10/1974 | Smith | 101/415.1 |
| 4,010,685 | 3/1977 | Trageser | 101/415.1 |

FOREIGN PATENT DOCUMENTS 2631119 1/1978 Fed. Rep. of Germany ..... 101/415.1

*Primary Examiner*—William Pieprz

*Attorney, Agent, or Firm*—Leydig, Voit, Osann, Mayer & Holt

[57] ABSTRACT

A mechanism for securing and tightening a blanket on a cylinder of a printing press, particularly an offset press, which includes a rockable clamping shaft mounted in the groove on the cylinder together with a movable jaw member on the shaft, the jaw member being rockable between open and closed positions about an axis which extends longitudinally adjacent the surface of the shaft, so that when the shaft is in a reference position and the jaw member is open, an entryway is created which faces chordwise of the cylinder. The jaw member is held open against a force of bias by a stop surface on the cylinder for reception of a reinforcing bar at the end of the blanket, but when the shaft is manually rotated away from its reference position the jaw is automatically closed to capture the bar following which the bar is swung in a direction to tighten the blanket. A similar mechanism, in mirror image, is provided in the groove for the other end of the blanket, the mechanisms being shielded by a permanently installed gap cover. The latter defines slots along its longitudinal edges aligned with the entryways and through which the ends of the blanket are fed and retracted.

6 Claims, 4 Drawing Figures

DEVICE FOR FITTING A BLANKET ON THE CYLINDER OF A PRINTING PRESS

In a conventional blanket cylinder on a printing press, in particular a sheet-fed offset press, a blanket is clamped at its ends and then tightened about the cylinder. A representative patent showing such a device is U.S. Pat. No. 1,215,344 which describes a blanket fitting device in which a clamping bar, to which the end of the blanket is secured, is inserted into a captive position on a rockable clamping shaft and held in place by a spring bolt, following which the shaft is manually rocked for tightening of the blanket.

In German Auslegeschrift No. 22 52 949 a reinforced end of the blanket is held captive in a pocket formed on the side of the shaft, following which the blanket is tightened by rocking of the shaft.

In conventional blanket cylinders the groove in the cylinder surface in which the ends of the blanket are anchored, and which contains the tightening mechanism, is often covered, for safety purposes, by a gap cover which must be removed during anchoring and adjusting of the blanket and then replaced before the press is started. The securing means for the gap cover is generally quite elaborate, in order to insure positive retention, so that removal and reinstallation of the gap cover requires considerable time which, of course, is non-productive.

The purpose of the present invention is to provide a mechanism for securing the ends of a blanket on a blanket cylinder which insures positive rentention and permits precise tensioning of the blanket without requiring the gap cover to be removed. Accordingly, it is an object to provide a mechanism for anchoring and tightening a blanket on a blanket cylinder in which a blanket may be installed and adjusted in an absolute minimum of time, thereby increasing the productive time of the press. More specifically it is an object to provide a blanket anchoring and tightening mechanism in which the reinforced ends of the blanket are simply inserted chordwise into narrow grooves in the blanket cylinder surface into a stop position, subsequent manual rotation of the shaft serving automatically to positively anchor the end of the blanket with respect to the shaft followed by tightening of the blanket to proper degree.

It is, therefore, an object to provide a blanket anchoring and tightening mechanism in which both anchoring and tightening are performed in sequence by rotation of a single screw in one direction and in which loosening and release are performed with equal simplicity by rotation of the screw in the opposite direction. Thus it is an object to provide means for installing and removing a blanket from a cylinder which may be reliably and quickly operated without requiring any skill or experience. Since the gap cover need not be removed or replaced there is no risk that the press might be started with the gap cover inadequately attached, thereby removing one of the serious risks of conventional practice.

Notwithstanding the features of safety and convenience brought about by the present mechanism, the mechanism is nevertheless inherently simple, foolproof in operation, and highly economical both to construct and to maintain.

Other objects and advantages of the invention will become apparent upon reading the attached detailed description and upon reference to the drawings in which.

Figure 1:
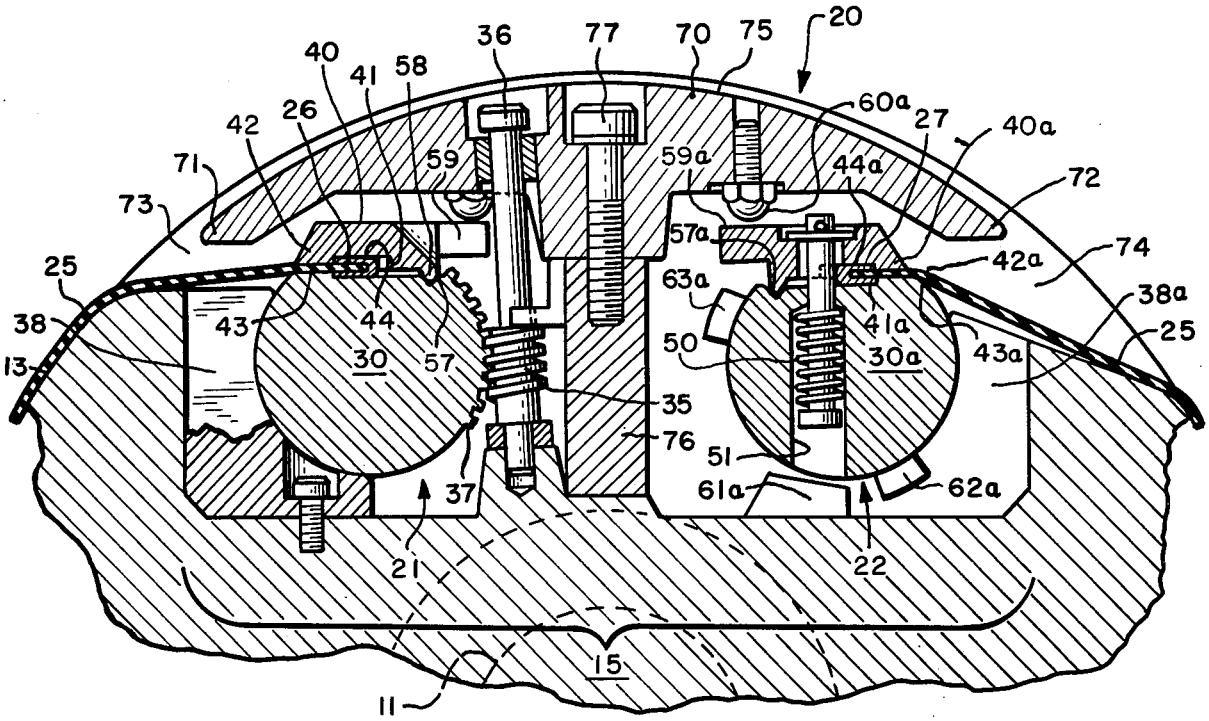
FIG. 1 is a transverse fragmentary section taken through typical mechanism of the present invention looking along line 1—1 in FIG. 2.
Figure 2:
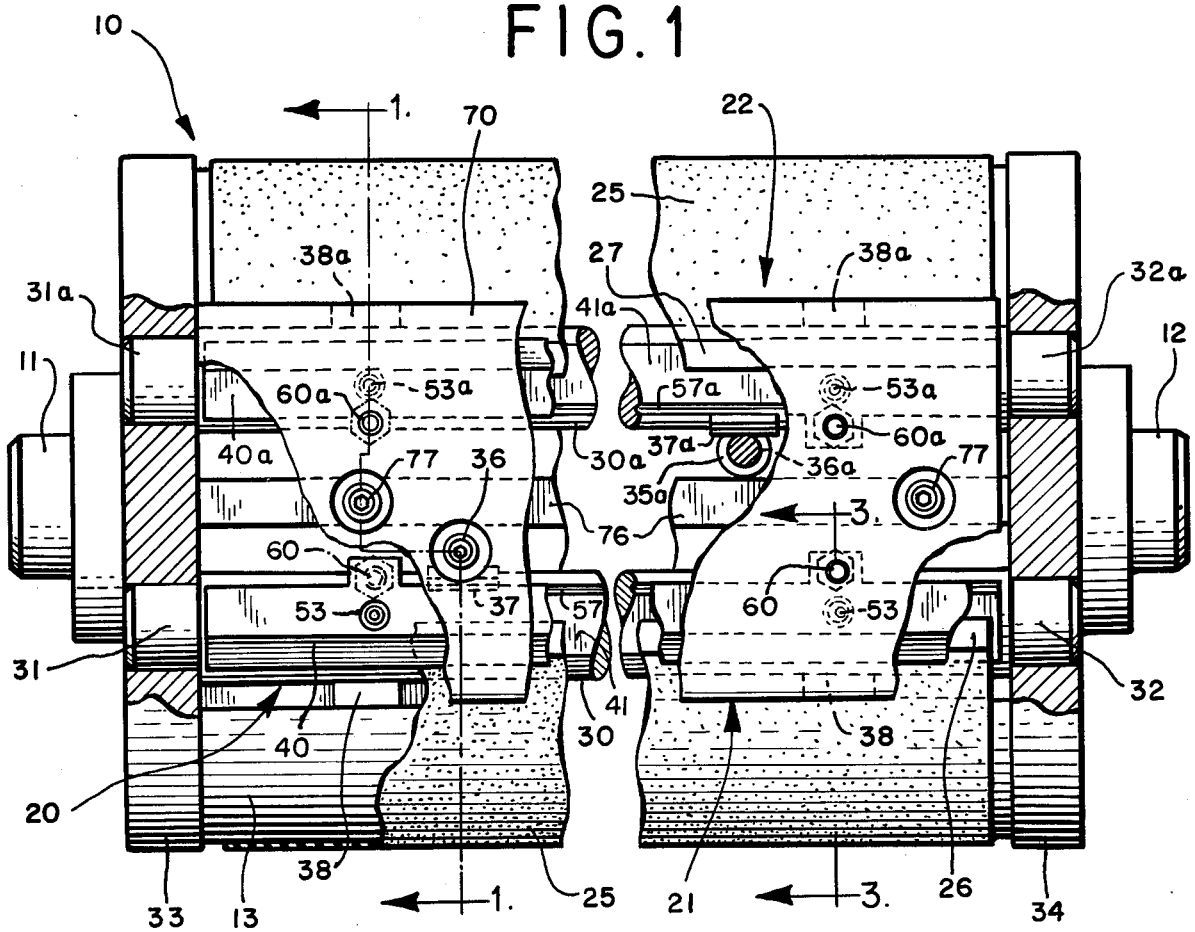
FIG. 2 is a plan view, in partial section, of the blanket cylinder shown in FIG. 1.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Turning now to the drawings, the blanket cylinder, generally indicated at 10, has stubshafts 11, 12 which are suitably journaled in the press frame. The cylinder has an outer surface 13 in which is formed a longitudinally extending groove 15 resulting in a relatively wide gap. Installed in the gap is a blanket anchoring and tightening mechanism generally indicated at 20 and which consists of separate leading and trailing edge mechanisms 21, 22 which are mirror images of one another and which serve to engage the opposite ends of the blanket. The latter, indicated at 25, has reinforcing bars 26, 27 at its respective end edges.

Turning attention first to the left-hand mechanism 21, it includes a clamping shaft 30 having stubshafts 31, 32 which are journaled in the end walls 33, 34, respectively, of the cylinder. For the purpose of rocking the shaft 30, a manually operated worm and worm wheel drive is provided which includes a worm 35 mounted upon a radially extending shaft having a head 36 engageable by a socket wrench or other turning tool. The worm meshes with a worm wheel 37 mounted on the periphery of the shaft; thus turning the head 36 in one direction tends to tighten the blanket while turning the head in the opposite direction tends to loosen it. Arcuate partial bearings 38 engage the wall of the shaft at axially spaced points to prevent the shaft from bowing when the belt is in taut condition.

Figure 3:
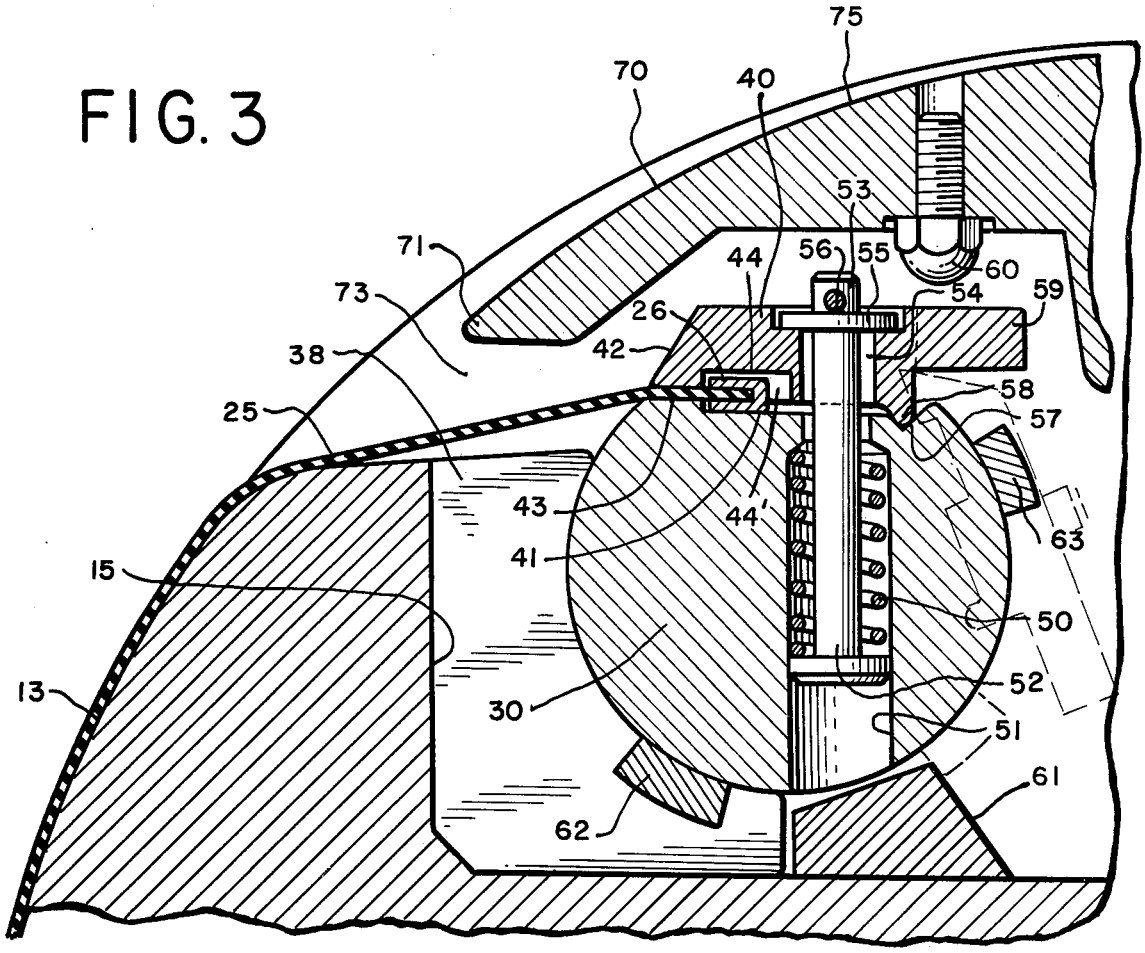
FIG. 3 is a fragmentary enlarged view of one of the clamping shafts shown in FIG. 1 with its associated jaw member and biasing spring, the section being taken along line 3—3 in FIG. 2.

In accordance with the present invention a jaw member extends longitudinally along the surface of the shaft cooperating with a jaw seat on the shaft with means for moving the jaw to an open blanket-receiving position when the shaft is in a reference position and with manual rocking movement of the shaft serving, sequentially, to close the jaw to capture bar 26 and to swing the bar in a direction to tighten the blanket. Thus a jaw member is provided in the form of a flat bar 40 which extends from one end of the shaft 30 to the other, being accommodated by a flat 41 which extends along the "upper" surface of the shaft. The jaw member has a jaw 42 which cooperates with a jaw seat 43 on the shaft. Behind the jaw and jaw seat is a recess 44 in which the reinforcing bar 26 on the blanket is held captive as long as the jaw is closed. The jaw member is normally held, resiliently biased against the shaft, by a pair of biasing springs 50, one of which is shown in FIG. 3. The spring 50 is telescoped into a bore 51 which extends chordwise in the shaft. Engaging the end of the spring is a headed pin 52 having a tip 53 which extends through a clearance opening 54 in the jaw member to hold the latter captive by a washer 55 and cross pin 56.

In carrying out the invention in its preferred form, the jaw member 40 is hinged for rocking movement with respect to the shaft about an axis which extends longitudinally adjacent the surface of the shaft and the jaw member is extended beyond the axis to form an actuating arm thereby causing the jaw member to be in the form of a lever of the first class, a stop being interposed in the path of the actuating arm for engaging it, and thereby opening the jaw, as the shaft is moved into a reference position, with the jaw being closed automatically as the shaft is rotated away from reference position in the blanket-tightening direction. The pivot axis is defined by a groove 57 in the shaft which is engageable by a ridge 58 on the underside of the jaw member, the extended actuating arm being indicated at 59.

Figure 3A:
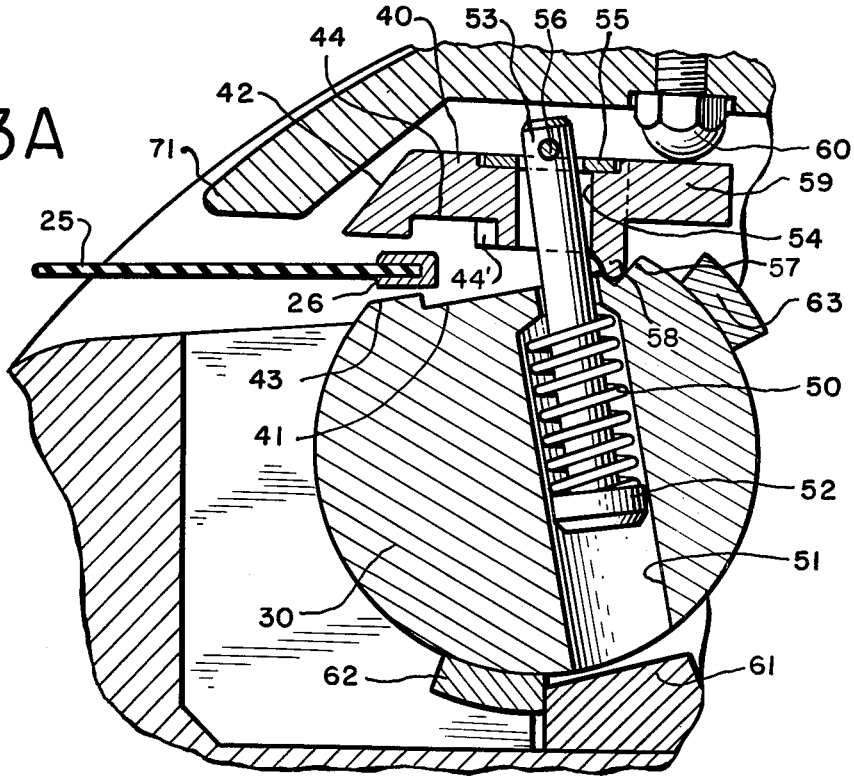
FIG. 3*a* shows the blanket being inserted.

FIG. 3 illustrates the position of the shaft just short of its reference position, a stop 60, which is anchored with respect to the cylinder, being interposed in the path of movement of the actuating arm 59 so that as the shaft 30 rocks counterclockwise into its reference position the jaw is opened. This condition is illustrated in FIG. 3*a* which shows the reference position of the shaft, with the stop 60 performing its function of engaging the arm 59 to rock the jaw member about its hinge axis against the force of the biasing spring 50. To precisely determine the reference position, in which the jaw is fully opened, a fixed stop 61 is provided in the root of the groove in the path of movement of a movable stop 62 on the shaft. Rocking of the shaft in the blanket-tightening direction is, conversely, limited by a stop 63 on the shaft.

In accordance with one of the aspects of the present invention the groove 15 and the blanket anchoring and tightening mechanisms is shielded by a gap cover 70 having lateral edges 71, 71 defining relatively narrow longitudinal slots 73, 74 through which the ends of the blanket are inserted and retracted. The gap cover has an outer surface 75 which is of arcuate contour and which is substantially a continuation of the surface 13 of the cylinder. It is one of the distinguishing features of the invention that the gap cover 70 is more or less permanently installed, being removed only when servicing of the mechanism is required. The gap cover is mounted upon a pedestal 76 which extends axially along the center of the groove and to which the cover is secured by a set of clamping screws 77.

While the invention has been described thus far in connection with the anchoring and tensioning mechanism 21 at the left-hand side of FIG. 1, it will be understood that the mechanism 22 at the right-hand side, and which engages the other end of the blanket, is substantially identical in construction and function, with similar parts being indicated by the same reference numerals with the addition of subscript "a". The stops 60, 60*a*, it will be noted, are conveniently mounted on the underside of the gap cover 70. In a typical blanket installation the driving connections 36, 36*a* of the clamping shafts are turned until the shafts are in reference, or receiving, position, (FIG. 3*a*) such being sensed by the operator upon the bottoming of stops 61, 62 and 61*a*, 62*a*. The reinforcing bars 26, 27 at the ends of the blanket are then fed chordwise into the slots 73, 74 at the edges of the gap cover 70 until the rods, passing through the entryway of the jaws, drop into the respective recesses 44, 44*a*. Taking the left-hand mechanism as representative, the degree of insertion of the bar 26 may, if desired, be limited by an auxiliary stop 44'.

Next, rotating the shaft drive connection 36 in the opposite, or blanket-tightening, direction, a sequential action occurs: As the shaft 30 rotates clockwise the actuating arm 59 on the jaw member is progressively released, permitting the biasing spring 50 to expand and thereby close the jaw 42 with respect to the jaw seat 43 to hold the bar 26 at the end of the blanket securely captive. Continued rotation of the drive connection 36 in the same direction, to produce continued clockwise rocking of the shaft 30, progressively pulls the end of the blanket in the tightening direction. Rocking of the shaft in such direction is positively limited by engagement of stops 63, 61.

Next the shaft 30*a* at the other end of the blanket is manually rotated away from its reference position resulting in the same sequence, that is, closing of the jaws to hold the reinforcing bar captive followed by gradually increased tension in the blanket until running tension is achieved, whereupon the blanket cylinder is ready for use without necessity for reinstalling the gap cover 70.

Removal of the blanket is equally simple: The drive connections 36, 36*a* are rotated in the blanket loosening direction, with the final portion of the rocking movement of the shaft, as the shaft moves into its reference position defined by stops 61, 62, serving to engage the actuating arms 59, 59*a* with the fixed stops 60, 60*a*, thereby to open the jaws so that the ends of the blanket may be simply pulled out of the receiving slots 73, 74.

It is apparent that the objects of the invention have been amply fulfilled. No particular skill or experience is required to install a blanket. The drive connections 36, 36*a* are simply rotated to a reference position, indicated by the bottoming of stops, the ends of the blanket are inserted, and the drive connections then are rotated in the opposite direction, automatically capturing the ends of the blankets, and until the blanket is in its tensioned condition. Anchoring and tensioning are thus achieved in a single operation and without necessity for removing or replacing the gap cover.

I claim as my invention:

1. A blanket cylinder for an offset printing press employing a resilient blanket having a reinforcing bar extending along its end edge comprising, in combination, a cylinder body having a longitudinal groove defining a gap in the cylinder surface, a shaft in the groove journaled for rocking movement from a reference position to a blanket tightening position, manual means for rockingly positioning the shaft, a jaw member having a central hinge defining a jaw on one side, a co-operating jaw seat on said shaft and an actuating arm on the other side, the hinge extending longitudinally at the surface of the shaft so that the jaw member is rockable with respect to jaw seat between an open position and a closed position, the jaw in its open position creating an entryway facing chordwise of the cylinder with the shaft in its reference position, the jaw having an inner recess extending longitudinally of the shaft and which is accessible through the entryway only when the jaw is in open position for receiving the reinforcing bar on the blanket, a biasing spring carried by the shaft for biasing the jaw into closed position, a stop supported on the cylinder in the path of movement of the actuating arm so positioned that (a) the actuating arm is engaged to open the jaw against the force of bias when the shaft is in its reference position enabling the reinforcing bar on the blanket to be inserted into the recess and that (b) manual rotation of the shaft from its reference position moves the actuating arm away from the stop for closure of the jaw by the spring to capture the bar in the recess and for thereafter swinging the bar to tighten the blanket.

2. A blanket cylinder for an offset printing press employing a resilient blanket having a reinforcing bar extending along its end edge comprising, in combination, a cylinder body having a longitudinal groove defining a gap in the cylinder surface, a shaft in the groove journaled for rocking movement from a reference position to a blanket tightening position, manual means for rockingly positioning the shaft, the shaft having a flat on one side thereof and terminating in a jaw seat, a jaw member in the form of a metal bar of a generally rectangular cross-section flatly overlying the flat on the shaft, the jaw member defining a jaw along the front edge cooperating with the jaw seat on the shaft and having its rear edge extended tangentially beyond the shaft to provide an actuating arm, a hinge connection including a ridge and groove interposed between the jaw member and the shaft inwardly of the actuating arm, means including a spring on the shaft for holding the jaw member in closed position flatly on the shaft with the jaw engaging the jaw seat, the jaw and seat together defining a recess extending longitudinally of the shaft and which is accessible only when the jaw is in open position for receiving the reinforcing bar on the blanket, a stop supported on said cylinder in the path of movement of the actuating arm for engaging the actuating arm, the stop being so positioned that (a) as the shaft is rocked to reference position the jaw is opened for reception of the reinforcing bar on the blanket and (b) as the shaft is subsequently rocked in the opposite direction away from the reference position the jaw closes under the force of bias to capture the reinforcing bar in the recess followed by swinging of such bar to tighten the blanket.

3. The combination as claimed in claim 1 or claim 2 in which interengaging stops are provided on the shaft and on the cylinder for signalling to the operator the reference position of the shaft thereby insuring that the jaw is in open position in readiness for receiving the reinforcing bar on the blanket.

4. The combination as claimed in claim 1 or claim 2 in which the cylinder includes an arcuately surfaced gap cover for bridging the groove and for forming a substantial continuation of the cylindrical surface of the cylinder, the gap cover overlying the shaft and having a longitudinal edge spaced from the adjacent longitudinal edge of the groove to define an entry slot for the reinforcing bar which is substantially aligned with the entryway of the jaw when the shaft is in its reference position.

5. The combination as claimed in claim 1 or claim 2 a second similar shaft and jaw mechanism is provided in the groove in mirror image relation to the first, a gap cover overlying the groove and having an arcuate outer surface which serves as a substantial continuation of the surface of the cylinder thereby to protect the mechanisms in the goove, the gap cover having longitudinal edges which stop short of the longitudinal edges of the groove thereby to provide respective entryway slots for insertion and retraction of reinforcing bars at the respective ends of the blanket.

6. The combination as claimed in claim 1 or claim 2 in which the cylinder includes an arcuately surfaced gap cover for bridging the groove and for forming a substantial continuation of the cylindrical surface of the cylinder, the gap cover overlying the shaft and having a longitudinal edge spaced from the adjacent longitudinal edge of the groove to define an entry slot for the reinforcing bar, the stop being mounted on the underside of the gap cover integral therewith and arranged in the path of movement of the jaw member as the shaft moves into reference position.

* * * * *